US010933662B2

(12) United States Patent
Akima et al.

(10) Patent No.: US 10,933,662 B2
(45) Date of Patent: Mar. 2, 2021

(54) IMAGE FORMING METHOD, IMAGE FORMING APPARATUS, AND IMAGE-FORMED MATTER

(71) Applicants: Mio Akima, Tokyo (JP); Hiroki Nakane, Kanagawa (JP)

(72) Inventors: Mio Akima, Tokyo (JP); Hiroki Nakane, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/522,905

(22) Filed: Jul. 26, 2019

(65) Prior Publication Data

US 2020/0039245 A1 Feb. 6, 2020

(30) Foreign Application Priority Data

Jul. 31, 2018 (JP) ..... JP2018-144462
Jun. 26, 2019 (JP) ..... JP2019-118029

(51) Int. Cl.
*B41J 11/00* (2006.01)
*B41M 5/00* (2006.01)

(52) U.S. Cl.
CPC ..... *B41J 11/002* (2013.01); *B41M 5/0011* (2013.01)

(58) Field of Classification Search
CPC ..... B41J 11/002; B41M 5/0011
See application file for complete search history.

(56) References Cited

U.S. PATENT DOCUMENTS

2003/0064208 A1* 4/2003 Yamada ..... B41M 5/52 428/195.1
2004/0009294 A1* 1/2004 Kuribayashi ..... C09D 11/32 427/212

FOREIGN PATENT DOCUMENTS

| | | |
|---|---|---|
| JP | 56-028256 | 3/1981 |
| JP | 3-056573 | 3/1991 |
| JP | 3-079678 | 4/1991 |
| JP | 3-160068 | 7/1991 |
| JP | 4-018462 | 1/1992 |
| JP | 2003-300029 | 10/2003 |
| JP | 2005-235448 | 9/2005 |
| JP | 2010-241999 | 10/2010 |
| JP | 2011-178895 | 9/2011 |
| JP | 2012-251062 | 12/2012 |
| JP | 2014-189715 | 10/2014 |

* cited by examiner

*Primary Examiner* — Geoffrey S Mruk
(74) *Attorney, Agent, or Firm* — Oblon, McClelland, Maier & Neustadt, L.L.P.

(57) ABSTRACT

An image forming method is provided. The image forming method includes the process of discharging an ink onto a recording medium. The ink comprises a cross-linking agent reactive with an acidic group and a resin having the acidic group reactive with the cross-linking agent. The recording medium has the acidic group reactive with the cross-linking agent on a surface thereof.

11 Claims, 3 Drawing Sheets

IMAGE FORMING METHOD, IMAGE FORMING APPARATUS, AND IMAGE-FORMED MATTER

CROSS-REFERENCE TO RELATED APPLICATIONS

This patent application is based on and claims priority pursuant to 35 U.S.C. § 119(a) to Japanese Patent Application Nos. 2018-144462 and 2019-118029, filed on Jul. 31, 2018 and Jun. 26, 2019, respectively, in the Japan Patent Office, the entire disclosure of each of which is hereby incorporated by reference herein.

BACKGROUND

Technical Field

The present disclosure relates to an image forming method, an image forming apparatus, and image-formed matter.

Description of the Related Art

Water-based inks used in inkjet printing are free of volatile component and are advantageous in terms of safety and environmental considerations. However, an image printed with water-based inks on high-quality paper or plain paper is likely to blur. In addition, an image printed with water-based inks on printing paper is difficult to sufficiently dry and therefore difficult to print at high speeds. Furthermore, an image printed with water-based inks on cotton or cotton blends cannot achieve a desired image quality because the inks permeate the fiber without remaining on the surface of the fiber. Moreover, the inks cannot be fixed on impermeable recording media which are not absorptive to inks, such as polymer resin films, ceramics, and glass substrates.

On the other hand, ultraviolet-curable inks ("UV-curable inks") used in inkjet printing can be fixed on polymer resin films, ceramics, and glass substrates and have high followability to the surface of such substrates. UV-curable inks are advantageous in terms of high-speed printing because they use a photocurable reaction. However, UV-curable inks are poor in terms of safety and environmental considerations because of containing a polymerization initiator in large amount. Furthermore, the coated film of UV-curable inks has a high pile height, which results in poor secondary processability such as lamination processing.

In attempting to solve the above-described problems, various water-based UV inks have been proposed. For example, an inkjet ink has been proposed which contains a resin emulsion comprising a compound having a radical-polymerizable group, a non-polymerizable resin emulsion, and a photoradical polymerization initiator.

In addition, an inkjet textile printing ink has been proposed which contains a water-soluble pigment dispersing agent having a cross-linkable functional group, a water-soluble fixing agent having a cross-linkable functional group, and a cross-linking agent.

SUMMARY

In accordance with some embodiments of the present invention, an image forming method is provided. The image forming method includes the process of discharging an ink onto a recording medium. The ink comprises a cross-linking agent reactive with an acidic group and a resin having the acidic group reactive with the cross-linking agent. The recording medium has the acidic group reactive with the cross-linking agent on a surface thereof.

In accordance with some embodiments of the present invention, an image forming apparatus is provided. The image forming apparatus includes a discharger containing an ink comprising a cross-linking agent reactive with an acidic group and a resin having the acidic group reactive with the cross-linking agent. The discharger is configured to discharge the ink onto a recording medium having the acidic group reactive with the cross-linking agent on a surface thereof. The image forming apparatus further includes a recording medium container containing the recording medium.

In accordance with some embodiments of the present invention, image-formed matter is provided. The image-formed matter includes a recording medium and an image layer on the recording medium. The image layer contains a cross-linking agent reactive with an acidic group and a resin having the acidic group reactive with the cross-linking agent. The recording medium has the acidic group reactive with the cross-linking agent on a surface thereof.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
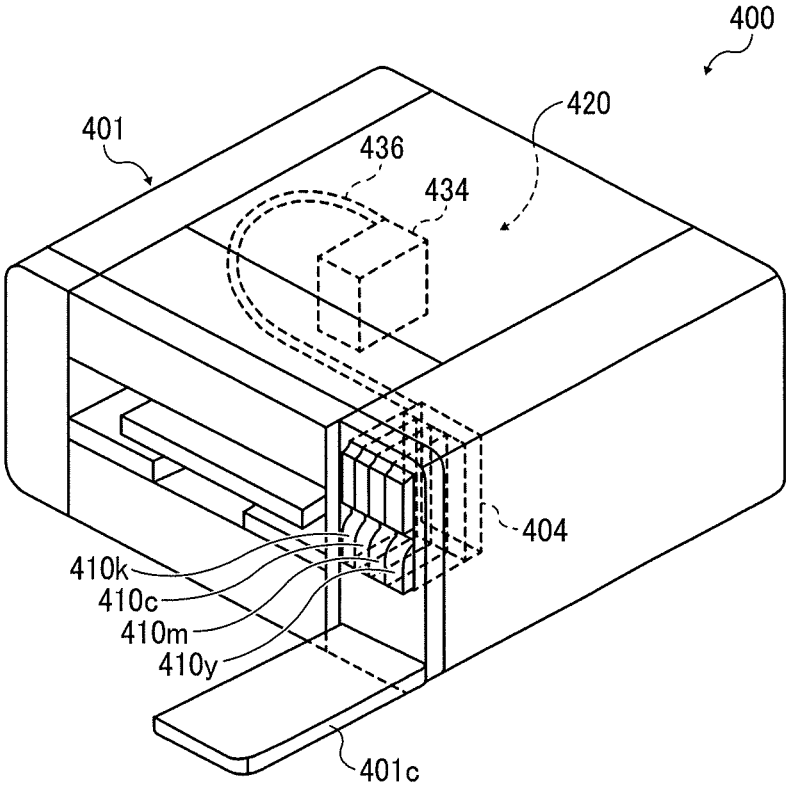
FIG. 1 is a schematic view of an image forming apparatus according to an embodiment of the present invention for conducting an image forming method according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with an embodiment of the present invention, an image forming method having excellent discharge stability and capable of forming image-formed matter having adhesiveness, rub resistance, and chemical resistance is provided.

Image Forming Method and Image Forming Apparatus

The image forming method according to an embodiment of the present invention includes a discharge process for discharging an ink onto a recording medium. The ink comprises a cross-linking agent reactive with an acidic group and a resin having the acidic group reactive with the cross-linking agent. The recording medium has the acidic group reactive with the cross-linking agent on a surface thereof. Preferably, the image forming method further includes a surface treatment process and an ultraviolet irradiation process. The image forming method may further include other processes, as necessary.

The image forming apparatus according to an embodiment of the present invention includes: a discharger containing an ink, configured to discharge the ink onto a recording medium; and a recording medium container containing the recording medium. The ink comprises a cross-linking agent reactive with an acidic group and a resin having the acidic group reactive with the cross-linking agent. The recording medium has the acidic group reactive with the cross-linking agent on a surface thereof. Preferably, the image forming apparatus further includes a surface treatment device and an ultraviolet irradiator. The image forming apparatus may further include other devices, as necessary.

The image forming method according to an embodiment of the present invention can be suitably performed by the image forming apparatus according to an embodiment of the present invention. The discharge process can be performed by the discharger, the surface treatment process can be performed by the surface treatment device, the ultraviolet irradiation process can be performed by the ultraviolet irradiator, and the other processes can be performed by the other devices.

The image forming method and image forming apparatus according to some embodiments of the present invention are achieved based on a finding that the above-described conventional inkjet ink is insufficient in terms of rub resistance, adhesiveness, and chemical resistance of image-formed matter, because an image formed with this ink on a PVC recording medium cannot maintain its original state as a result of a rub resistance test.

In addition, the image forming method and image forming apparatus according to some embodiments of the present invention are achieved based on another finding that the above-described inkjet textile printing ink is insufficient in terms of rub resistance, adhesiveness, and chemical resistance of image-formed matter without pretreatment, because this ink is designed to have a pretreatment.

According to an embodiment of the present invention, the cross-linking agent reactive with an acidic group contained in the ink reacts with both the acidic group of the resin contained in the ink and the acidic group on the surface of the recording medium. Thus, both the cross-linking agent and the resin reacted with the cross-linking agent form bonding with the recording medium. As a result, adhesiveness, rub resistance, and chemical resistance of image-formed matter are improved without impairing discharge stability of the ink.

Discharge Process and Discharger

The discharge process is a process for discharging an ink comprising a cross-linking agent reactive with an acidic group and a resin having the acidic group reactive with the cross-linking agent onto a recording medium. The discharge process is performed by the discharger.

Examples of the discharger include, but are not limited to, an ink discharge head.

The ink discharge head is configured to discharge an ink to form an image layer.

The ink discharge head includes a nozzle plate, a pressure chamber, and a stimulus generator.

Nozzle Plate

The nozzle plate includes a nozzle substrate and an ink repellent film on the nozzle substrate.

Pressure Chamber

The pressure chamber is disposed corresponding to each of multiple nozzle holes provided on the nozzle plate. The pressure chamber is an individual channel communicated with each nozzle hole. The pressure chamber may also be referred to as ink flow path, a pressurized liquid chamber, a discharge chamber, or a liquid chamber.

Stimulus Generator

The stimulus generator is configured to generate a stimulus to be applied to the ink.

The stimulus generated by the stimulus generator is not particularly limited and may be appropriately selected depending on the objective. Examples thereof include, but are not limited to, heat (temperature), pressure, vibration, and light. Each of these members can be used alone or in combination with others. Among these, heat and pressure are preferable.

Examples of the stimulus generator include, but are not limited to, a heater, a presser, a piezoelectric element, a vibration generator, an ultrasonic oscillator, and a light source. More specifically, the stimulus generator may be a piezoelectric actuator such as a piezoelectric element; a thermal actuator using phase change of ink caused by film boiling, using a thermoelectric conversion element such as a heat element; a shape-memory alloy actuator using a metal phase change caused by temperature change; and an electrostatic actuator using an electrostatic force.

When the stimulus is "heat", the ink in the ink discharge head is given heat energy corresponding to a recording signal by, for example, a thermal head. In this case, bubbles are generated in the ink by the heat energy, and the ink is discharged as droplets from the nozzle holes of the nozzle plate by the pressure of the bubbles.

When the stimulus is "pressure", for example, a piezoelectric element bonded to the pressure chamber in the ink flow path in the ink discharge head is applied with a voltage, to make the piezoelectric element bent. As a result, the volume of the pressure chamber is reduced, and the ink is discharged as droplets from the nozzle holes of the ink discharge head.

Among these, a piezo method that applies a voltage to a piezo element to jet an ink is preferable.

Ink

The ink contains a cross-linking agent reactive with an acidic group and a resin having the acidic group reactive with the cross-linking agent, and further contains other components, as necessary.

Cross-Linking Agent Reactive with Acidic Group

The cross-linking agent reactive with an acidic group is not particularly limited and can be appropriately selected according to the objective as long as it is reactive with an acidic group. Examples thereof include, but are not limited to, compounds having carbodiimide group, compounds having isocyanate group, compounds having aziridine group, compounds having melamine group, compounds having epoxy group, compounds having oxazoline group, compounds having amino group, compounds having azo group, and compounds having bismaleimide group. Each of these members can be used alone or in combination with others. Among these, compounds having carbodiimide group and compounds having oxazoline group are preferable for adhesiveness, rub resistance, and chemical resistance.

The compounds having carbodiimide group are available either synthetically or commercially. Examples of the commercially-available products thereof include, but are not limited to, carbodiimide (CARBODILITE E-03A available from Nisshinbo Chemical Inc.).

The compounds having an oxazoline group are available either synthetically or commercially. Examples of the commercially-available products thereof include, but are not limited to, oxazoline (EPOCROS K-2020E available from NIPPON SHOKUBAT CO., LTD.).

The proportion of the cross-linking agent reactive with an acidic group in the ink is preferably from 1% to 20% by mass, more preferably from 2% to 10% by mass.

The cross-linking agent reactive with an acidic group reacts with the resin having the acidic group contained in the ink and the recording medium having the acidic group on a surface thereof by the action of a curing device.

Examples of the acidic group reactive with the cross-linking agent include, but are not limited to, carboxyl group, phenolic hydroxyl group, alcoholic hydroxyl group, amine group, amide group, aromatic thiol group, epoxy group, caprolactam, and acid anhydride group. Among these, carboxyl group and alcoholic hydroxyl group are particularly preferable.

Curing Device

The curing device is configured to cure the ink according to an embodiment of the present invention. Examples thereof include, but are not limited to, a heat curing device and an active energy ray curing device.

Examples of the heat curing device include, but are not limited to, a device configured to heat and dry the printed surface and the reverse surface of a recording medium, such as an infrared heater, a hot air heater, and a heat roller. Each of these members can be used alone or in combination with others.

The method of drying the recording medium is not particularly limited and may be appropriately selected according to the objective. For example, the method may include: bringing a heated fluid, such as warm air, into contact with the recording medium to which the ink is applied; bringing a heat member into contact with the recording medium to which the ink is applied to heat the recording medium by heat transfer; or irradiating the recording medium to which the ink is applied with energy rays such as infrared rays and far-infrared rays to heat the recording medium.

The heating can be performed either before, during, or after a printing.

The heating before or during the printing makes it possible to make a print on a heated recording medium. The heating after the printing makes it possible to dry image-formed matter.

The drying temperature at the time of recording is preferably 50 degrees C. or more. The upper limit of the drying temperature at the time of recording is not particularly limited and may be appropriately selected depending on the objective, but is preferably 120 degrees C. or less for discharge reliability and thermal deformation of the substrate. More preferably, the drying temperature is 90 degrees C. or less for wettability of the ink to the recording medium. The drying temperature before and after the recording is not particularly limited and may be appropriately selected according to the objective, but is preferably 100 degrees C. or less for discharge reliability and thermal deformation of the recording medium.

The heating time is not particularly limited and may be appropriately selected depending on the objective, but is preferably from 0.5 to 1.5 seconds.

The heating time is preferably controlled by controlling the conveyance speed of the recording medium.

Active energy rays for curing the ink according to an embodiment of the present invention is not particularly limited as long as it is capable of giving energy required to proceed a polymerization reaction of polymerizable components included in the ink. Examples thereof include, but are not limited to, ultraviolet rays, electron beams, α-rays, β-rays, γ-rays, and X-rays. Particularly when a high-energy light source is used, the polymerization reaction can proceed without a polymerization initiator. In the case of ultraviolet ray emission, mercury-free light sources are strongly desired for environment preservation. Replacement with a GaN-based semiconductor ultraviolet ray emitter is very useful both industrially and environmentally. In addition, ultraviolet light-emitting diodes (UV-LED) and ultraviolet laser diodes (UV-LD) are preferable as ultraviolet light sources since they have a compact size, an extended lifespan, and a high efficiency, and low in cost.

Resin Having Acidic Group

Examples of the resin having the acidic group include, but are not limited to, homopolymers or copolymers of acrylic acid, acrylate, methacrylic acid, methacrylate, acrylonitrile, cyanoacrylate, acrylamide, olefin, styrene, vinyl acetate, vinyl chloride, isocyanate, vinyl alcohol, alcohol, vinyl ether, vinyl pyrrolidone, vinylpyridine, vinyl carbazole, vinyl imidazole, and/or vinylidene chloride, fluororesins, and natural resins. The copolymer can be in any form of a random copolymer, a block copolymer, an alternating copolymer, and a graft copolymer. Each of these members can be used alone or in combination with others.

Among these, acrylic resins, styrene-acrylic resins, acrylic-silicone resins, polyurethane resins, and polyester resins are preferable.

These resins may be in the form of particles (hereinafter "resin particles"). The resin particles may be dispersed in water, as a dispersion medium, to become a resin emulsion. The ink can be obtained by mixing the resin emulsion with other materials such as a colorant and an organic solvent. These resin particles are available either synthetically or commercially.

The volume average particle diameter of the resin particles is not particularly limited and can be suitably selected to suit to a particular application. The volume average particle diameter is preferably from 10 to 1,000 nm, more preferably from 10 to 200 nm, and most preferably from 10 to 100 nm, for good fixability and high image hardness.

The volume average particle diameter can be measured with a particle size analyzer (NANOTRAC WAVE-UT151 available from MicrotracBEL Corp.).

Preferably, the acid value of the resin having the acidic group is from 5 to 100 mgKOH/g for water dispersibility, and more preferably from 5 to 50 mgKOH/g for imparting excellent rub resistance and chemical resistance.

The acid value of a resin refers to the number of milligrams of potassium hydroxide required to neutralize an acid contained in 1 g of the resin, and can be measured according to the method described in JIS (Japanese Industrial Standards) K0070 specifying the method of measuring acid value, etc.

In order to disperse the resin particles in an aqueous medium, self-emulsifying and reactive-emulsifying resins that have an anionic group in the molecular structure are preferable.

The anionic group may be, for example, carboxyl group, carboxylate group, sulfonic acid group, or sulfonate group. Among these, carboxylate group or sulfonate group in each of which a part or whole thereof is neutralized by a basic compound or the like is preferably used, for maintaining good water dispersion stability. The anionic group can be introduced to the resin by using a monomer or reactive surfactant having the anionic group.

In the present disclosure, the acidic group includes those in equilibrium with the aforementioned anionic group for dispersion.

Examples of the basic compound that can be used to neutralize the anionic group include, but are not limited to, organic amines such as ammonia, triethylamine, pyridine, and morpholine, alkanolamines such as monoethanolamine, and metallic base compounds containing Na, K, Li, or Ca.

In the case of employing a forced emulsification method, both nonionic surfactants and anionic surfactants can be used, but nonionic surfactants are more preferable for improving water resistance.

Specific examples of the nonionic surfactants include, but are not limited to, polyoxyethylene alkyl ether, polyoxyethylene alkylene alkyl ether, polyoxyethylene derivatives, polyoxyethylene fatty acid ester, polyoxyethylene polyol fatty acid ester, polyoxyethylene propylene polyol, sorbitan fatty acid ester, polyoxyethylene hydrogenated castor oil, polyoxyalkylene polycyclic phenyl ether, polyoxyethylene alkylamine, alkyl alkanolamide, and polyalkylene glycol (meth)acrylate. Each of these members can be used alone or in combination with others. Among these, polyoxyethylene alkyl ether, polyoxyethylene fatty acid ester, polyoxyethylene sorbitan fatty acid ester, and polyoxyethylene alkylamine are preferable.

Specific examples of the anionic surfactants include, but are not limited to, alkyl sulfate, polyoxyethylene alkyl ether sulfate, alkyl benzene sulfonate, α-olefin sulfonate, methyl laurate, sulfosuccinate, ether sulfonate, ether carboxylate, fatty acid salt, naphthalenesulfonic acid formalin condensate, alkylamine salt, quaternary ammonium salt, alkyl betaine, and alkylamine oxide. Each of these members can be used alone or in combination with others. Among these, polyoxyethylene alkyl ether sulfate and sulfosuccinate are preferable.

The proportion of the surfactant to the total amount of the resin is preferably from 0.1% to 30% by mass, more preferably from 5% to 20% by mass. When the proportion of the surfactant is from 0.1% to 30% by mass, the ink has excellent adhesiveness and water resistance and forms image-formed matter without blocking.

The resin particles are preferably formed by a soap-free polymerization that is substantially free of the use of surfactant. The soap-free polymerization refers to a polymerization method for producing resin particles substantially without using a surfactant. In the soap-free polymerization, for example, polymer particles are polymerized in a solution which contains a surfactant in an amount of 1% by mass or less. In the soap-free polymerization, (meth)acrylic acid monomers can be suitably used. Polymer particles produced by the soap-free polymerization are likely to improve glossiness.

The resin having the acidic group are available commercially. Examples of commercially-available products of aqueous-dispersion-type polymer particles include, but are not limited to, an acrylic resin emulsion (MOVINYL 7470 available from The Nippon Synthetic Chemical Industry Co., Ltd.), an acrylic-silicone resin emulsion (MOVINYL 7110 manufactured by The Nippon Synthetic Chemical Industry Co., Ltd.), and a styrene-acrylic resin emulsion (MOVINYL 972 manufactured by The Nippon Synthetic Chemical Industry Co., Ltd.).

The proportion of the resin having the acidic group in the ink is not particularly limited and can be suitably selected according to the objective, but is preferably from 1% to 30% by mass, more preferably from 5% to 20% by mass, for fixability and storage stability of the ink.

Photoacid Generator

The photoacid generator is a compound that generates an acid upon irradiation with light. The ink preferably contains the photoacid generator for improving adhesiveness, rub resistance, and chemical resistance.

The photoacid generator is not particularly limited and well-known photoacid generators can be used, such as those described in the literature entitled "Application and Market of UV and EB Curing Technology" (published by CMC Publishing Co., Ltd, supervised by Yoneho TABATA, and edit by RadTech Japan). In the present disclosure, the photoacid generator may be used dissolved in a polymerizable compound or a solvent.

Examples of the photoacid generator include, but are not limited to, diazodisulfone compounds and triphenylsulfonium compounds.

The photoacid generator is commercially available. Examples of commercially-available products thereof include, but are not limited to, WPAG-367 (available from FUJIFILM Wako Pure Chemical Corporation).

The proportion of the photoacid generator in the ink is not particularly limited and can be suitably selected according to the objective, but is preferably from 0.1% to 10% by mass.

The ink may further contain other components such as water, an organic solvent, a surfactant, a defoamer, a preservative, a fungicide, a corrosion inhibitor, and/or a pH adjuster, as necessary.

Water

The proportion of water in the ink is not particularly limited and can be appropriately selected according to the objective, but is preferably from 10% to 90% by mass, more preferably from 20% to 60% by mass, for drying property and discharge reliability of the ink.

Organic Solvent

The organic solvent is not particularly limited and water-soluble organic solvents can be used. Examples thereof include, but are not limited to, polyols, ethers (e.g., polyol alkyl ethers and polyol aryl ethers), nitrogen-containing heterocyclic compounds, amides, amines, and sulfur-containing compounds.

Specific examples of the water-soluble organic solvents include, but are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethyl-2-imidazolidinone, ε-caprolactam, and γ-butyrolactone; amides such as formamide, N-methylformamide, N,N-dimethylformamide, 3-methoxy-N,N-dimethyl propionamide, and 3-butoxy-N,N-dimethyl propionamide; amines such as monoethanolamine, diethanolamine, and triethylamine; sulfur-containing compounds such as dimethyl sulfoxide, sulfolane, and thiodiethanol; propylene carbonate; and ethylene carbonate. Each of these members can be used alone or in combination with others.

In particular, organic solvents having a boiling point of 250 degrees C. or less are preferable, since they not only function as wetting agents but also provide good drying property.

In addition, polyol compounds having 8 or more carbon atoms and glycol ether compounds are also preferable.

Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The polyol compounds having 8 or more carbon atoms and the glycol ether compounds are capable of improving paper-permeability of the ink, which is advantageous when paper is used as a recording medium.

The proportion of the organic solvent in the ink is not particularly limited and can be appropriately selected according to the objective, but is preferably from 10% to 60% by mass, more preferably from 20% to 60% by mass, for drying property and discharge reliability of the ink.

Colorant

The colorant is not particularly limited, and pigments and dyes can be used as the colorant.

Usable pigments include both inorganic pigments and organic pigments. Each of these can be used alone or in combination with others. Mixed crystals can also be used as the colorant.

Usable pigments include black pigments, yellow pigments, magenta pigments, cyan pigments, white pigments, green pigments, orange pigments, glossy color pigments (e.g., gold pigments and silver pigments), and metallic pigments.

Specific examples of inorganic pigments include, but are not limited to, titanium oxide, iron oxide, calcium carbonate, barium sulfate, aluminum hydroxide, barium yellow, cadmium red, chrome yellow, and carbon black produced by a known method, such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, and quinophthalone pigments), dye chelates (e.g., basic dye chelate, acid dye chelate), nitro pigments, nitroso pigments, and aniline black. Among these pigments, those having good affinity for solvents are preferable. In addition, hollow resin particles and hollow inorganic particles can also be used.

Specific examples of pigments used for black-and-white printing include, but are not limited to: carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1).

Specific examples of pigments used for color printing include, but are not limited to: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (quinacridone magenta), 123, 146, 149, 166, 168, 170, 172, 177, 178, 179, 184, 185, 190, 193, 202, 207, 208, 209, 213, 219, 224, 254, and 264; C.I. Pigment Violet 1 (rhodamine lake), 3, 5:1, 16, 19, 23, and 38; C.I. Pigment Blue 1, 2, 15 (phthalocyanine blue), 15:1, 15:2, 15:3, 15:4 (phthalocyanine blue), 16, 17:1, 56, 60, and 63; and C.I. Pigment Green 1, 4, 7, 8, 10, 17, 18, and 36.

The dyes are not particularly limited, and acid dyes, direct dyes, reactive dyes, and basic dyes can be used. Two or more of these dyes can be used in combination.

Specific examples of the dyes include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the colorant in the ink is preferably from 0.1% to 15% by mass, more preferably from 1% to 10% by mass, for improving image density, fixability, and discharge stability.

The pigment can be dispersed in the ink by any of the following methods: introducing a hydrophilic functional group to the pigment to make the pigment self-dispersible;

covering the surface of the pigment with a resin; and dispersing the pigment by a dispersant.

In the method of introducing a hydrophilic functional group to the pigment to make the pigment self-dispersible, for example, a functional group such as sulfonic acid group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. In this case, the pigment may be referred to as a resin-covered pigment. In this case, not all the pigment particles included in the ink should be covered with a resin. It is possible that a part of the pigment particles is not covered with any resin or partially covered with a resin.

In the method of dispersing the pigment by a dispersant, low-molecular dispersants and high-molecular dispersants, represented by known surfactants, may be used.

More specifically, any of anionic surfactants, cationic surfactants, ampholytic surfactants, and nonionic surfactants may be used as the dispersant depending on the property of the pigment.

For example, a nonionic surfactant RT-100 (available from Takemoto Oil & Fat Co., Ltd.) and sodium naphthalenesulfonate formalin condensate are preferably used as the dispersant.

Each of the above dispersants may be used alone or in combination with others.

Pigment Dispersion

The ink can be obtained by mixing the pigment with other materials such as water and the organic solvent. The ink can also be obtained by, first, preparing a pigment dispersion by mixing the pigment with water, a pigment dispersant, etc., and thereafter mixing the pigment dispersion with other materials such as water and the organic solvent.

The pigment dispersion can be obtained by mixing water, the pigment, a pigment dispersant, and other components, if any. The pigment is dispersed in the pigment dispersion with the adjusted particle diameter. Preferably, the pigment dispersion is prepared with a disperser.

The particle diameter of the pigment dispersed in the pigment dispersion is not particularly limited. However, the median diameter that is the number-based maximum-frequency diameter of the pigment is preferably from 20 to 500 nm, more preferably from 20 to 150 nm, for improving dispersion stability of the pigment and enhancing discharge stability and image quality such as image density. The particle diameter of the pigment can be measured with a particle size analyzer (NANOTRAC WAVE-UT151 available from MicrotracBEL Corp.).

The proportion of the pigment in the pigment dispersion is not particularly limited and may be appropriately selected according to the objective, but is preferably from 0.1% to 50% by mass, more preferably from 0.1% to 30% by mass, for improving discharge stability and enhancing image density.

Preferably, the pigment dispersion is subjected to a filtration using a filter or a centrifugal separator to remove coarse particles having a particle size of 7 μm or more, followed by degassing.

The dispersion particle diameter (median diameter) of solid contents in the ink is not particularly limited and may be appropriately selected according to the objective. However, the median diameter that is the number-based maximum-frequency diameter is preferably from 20 to 1,000 nm, more preferably from 20 to 150 nm, for enhancing discharge stability and image quality such as image density. The solid contents include the resin particles and pigment particles. The particle diameter can be measured with a particle size analyzer (NANOTRAC WAVE-UT151 available from MicrotracBEL Corp.).

Surfactant

Usable surfactants include silicone-based surfactants, fluorine-based surfactants, ampholytic surfactants, nonionic surfactants, and anionic surfactants.

The silicone-based surfactants are not particularly limited and can be suitably selected to suit to a particular application. Among these, those which are not decomposed even in a high pH environment are preferable. Specific examples thereof include, but are not limited to, side-chain-modified polydimethylsiloxane, both-end-modified polydimethylsiloxane, one-end-modified polydimethylsiloxane, and side-chain-both-end-modified polydimethylsiloxane. In particular, those having a polyoxyethylene group and/or a polyoxyethylene polyoxypropylene group as the modifying group are preferable because they demonstrate good characteristics as an aqueous surfactant.

Specific examples of the silicone-based surfactants further include, but are not limited to, polyether-modified silicone-based surfactants, such as a dimethyl siloxane compound having a polyalkylene oxide structure unit on a side chain which is bonded to Si atom.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on its side chain, each of which have weak foaming property.

Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on a side chain include, but are not limited to, a sulfate of a polyoxyalkylene ether polymer having a perfluoroalkyl ether group on its side chain, and a salt of a polyoxyalkylene ether polymer having a perfluoroalkyl ether group on its side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate.

Each of these can be used alone or in combination with others.

Specific examples of the silicone-based surfactants include, but are not limited to, side-chain-modified polydimethylsiloxane, both-end-modified polydimethylsiloxane, one-end-modified polydimethylsiloxane, and side-chain-and-both-end-modified polydimethylsiloxane. More specifically, polyether-modified silicone-based surfactants having a polyoxyethylene group and/or a polyoxyethylene polyoxypropylene group as the modifying groups are preferable since they demonstrate good characteristics as an aqueous surfactant.

These surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

The polyether-modified silicone-based surfactants are not particularly limited and can be suitably selected according to the objective. Examples thereof include, but are not limited to, a compound represented by the following general formula (S-1) that is a dimethylpolysiloxane having a polyalkylene oxide structure on its side chain which is bonded to Si atom.

General Formula (S-1)

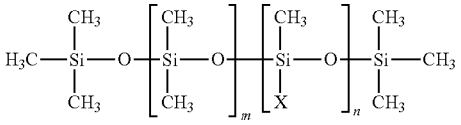

$X = -R(C_2H_4O)_a(C_3H_6O)_b R'$

In the formula (S-1), each of m, n, a, and b independently represents an integer, R represents an alkylene group, and R' represents an alkyl group.

Specific examples of commercially-available products of the polyether-modified silicone-based surfactants include, but are not limited to: KF-618, KF-642, and KF-643 (available from Shin-Etsu Chemical Co., Ltd.); EMALEX-SS-5602 and SS-1906EX (available from Nihon Emulsion Co., Ltd.); FZ-2105, FZ-2118, FZ-2154, FZ-2161, FZ-2162, FZ-2163, and FZ-2164 (available from Dow Corning Toray Co., Ltd); BYK-33 and BYK-387 (available from BYK Japan KK); and TSF4440, TSF4452, and TSF4453 (available from Momentive Performance Materials Inc.).

The proportion of the surfactant in the ink is not particularly limited and can be suitably selected according to the objective, but is preferably from 0.001% to 5% by mass, more preferably from 0.05% to 5% by mass, for improving wettability and discharge stability and enhancing image quality.

Defoamer

Specific examples of the defoamer include, but are not limited to, silicone defoamers, polyether defoamers, and fatty acid ester defoamers. Each of these can be used alone or in combination with others. Among these defoamers, silicone defoamers are preferable since they have excellent defoaming ability.

Preservative and Fungicide

Specific examples of the preservative and fungicide include, but are not limited to, 1,2-benzisothiazoline-3-one.

Corrosion Inhibitor

Specific examples of the corrosion inhibitor include, but are not limited to, acid sulphite and sodium thiosulfate.

pH Adjuster

The pH adjuster is not particularly limited as long as it is capable of adjusting the pH to 7 or higher. Specific examples thereof include, but are not limited to, amines such as diethanolamine and triethanolamine.

The properties of the ink, such as viscosity, surface tension, and pH, are not particularly limited and can be suitably selected to suit to a particular application.

Preferably, the ink has a viscosity of from 5 to 30 mPa·s, more preferably from 5 to mPa·s, at 25 degrees C., for improving print density and text quality and enhancing dischargeability. The viscosity can be measured at 25 degrees C. by a rotatory viscometer (RE-80L available from Toki Sangyo Co., Ltd.) equipped with a standard cone rotor (1° 34'×R24), while setting the sample liquid amount to 1.2 mL, the number of rotations to 50 rotations per minute (rpm), and the measuring time to 3 minutes.

Preferably, the ink has a surface tension of 35 mN/m or less, more preferably 32 mN/m or less, at 25 degrees C., so that the ink is suitably levelized on a recording medium and the drying time of the ink is shortened.

Preferably, the ink has a pH of from 7 to 12, more preferably from 8 to 11, for preventing corrosion of metal materials contacting the ink.

Surface Treatment Process and Surface Treatment Device

The surface treatment process is a process of conducting a corona discharge treatment or a plasma irradiation treatment on the recording medium before the ink lands on the recording medium. The surface treatment process is performed by the surface treatment device.

Recording Medium

The recording medium is not particularly limited. For example, plain paper, gloss paper, special paper, and cloth can be used. Also, impermeable substrates can be used to form good quality images.

The impermeable substrate refers to a substrate having a surface with a low level of moisture permeability and absorptivity. Examples of the impermeable substrate include a material having a number of hollow spaces inside but not open to the exterior. To be more quantitative, the impermeable substrate refers to a substrate that absorbs water in an amount of 10 mL/$m^2$ or less from the start of contact to 30 $msec^{1/2}$ after the start of contact, when measured according to the Bristow method.

Specific preferred examples of the impermeable substrate include, but are not limited to, plastic films such as vinyl chloride resin films, polyethylene terephthalate (PET) films, polypropylene films, polyethylene films, and polycarbonate films.

The recording medium is not limited to articles used as typical recording media. Examples of articles usable as the recording medium include: building materials such as wall paper, floor material, and tile; cloth for apparel such as T-shirt; textile; and leather. In addition, by adjusting the configuration of paths through which the recording medium is conveyed, ceramics, glass, and metals may be used as the recording medium.

The surface treatment of the recording medium is conducted prior to the landing of the ink. By the surface treatment, the acidic group reactive with the cross-linking agent is introduced to the surface of the recording medium. The acidic group on the surface of the recording medium forms chemical bonds with the cross-linking agent contained in the ink and with the combined product of the cross-linking agent and the resin contained in the ink.

The introduction of the acidic group to the recording medium is conducted by the surface treatment device. The surface treatment preferably includes at least one of ozone oxidation treatment, plasma irradiation treatment, corona discharge treatment, ultraviolet ray irradiation treatment, electron beam irradiation treatment, acid treatment, and alkali treatment. Among these, corona discharge treatment and plasma irradiation treatment are preferable.

The plasma irradiation treatment is performed by a plasma irradiator. The plasma irradiation treatment is to cut polymerization bonds on the surface of the recording medium. The acidic group can be introduced to the surface-modified recording medium by selecting an appropriate type of gas.

The corona discharge treatment is performed by a corona discharger. For example, a method disclosed in JP-2010-241999-A can be used, for producing a film comprising corona-treating the surface of a film by generating a streamer corona discharge by means of electrodes including a discharge electrode to which a high-frequency high voltage is applied and grounded electrodes each covered with an insulation material and electrically grounded, the grounded electrodes being arranged equidistantly on both sides of the proximity of the top of the discharge electrode, and passing the film through the streamer corona discharge region to corona-treat the surface of the film. The corona discharger may take a configuration in which inner and outer pairs of discharge electrodes are disposed at the central portion and the outer peripheral portion of a gas flow channel. Corona discharge is generated by applying a high voltage to the pair of discharge electrodes while introducing a gas into the gas flow channel, and a gas flow generated by the corona discharge is blown off.

Ultraviolet Irradiation Process and Ultraviolet Irradiator

The ultraviolet irradiation process is a process of irradiating the recording medium onto which the ink has been discharged with ultraviolet rays. The ultraviolet irradiation process is performed by the ultraviolet irradiator.

Upon irradiation with ultraviolet rays, an acid is generated from the photoacid generator in the ink, and chemical bonding between the acidic group on the surface of the recording medium and the cross-linking agent in the ink or the combined product of the cross-linking agent and the resin contained in the ink is accelerated. Thus, adhesiveness, rub resistance, and chemical resistance are improved.

The ultraviolet irradiator is not particularly limited and suitably selected according to the objective, and well-known ultraviolet irradiators can be used.

Other Processes and Other Devices

The other processes are not particularly limited and can be suitably selected according to the objective. Examples thereof include, but are not limited to, a control process.

The other devices are not particularly limited and can be suitably selected according to the objective. Examples thereof include, but are not limited to, a controller.

Use Application

The use application of the ink according to an embodiment of the present invention is not particularly limited. The ink can be used in any field in which inks are generally used. The ink can be applied to, for example, modeling resins, paints, adhesives, insulating materials, release agents, coating materials, sealing materials, resists, and optical materials.

Furthermore, the ink can be used to form two-dimensional texts and images and design coatings on various substrates. The ink can also be used as a material for forming three-dimensional images (i.e., three-dimensional objects). The material for forming three-dimensional objects can be used as a binder for binding powder particles in additive manufacturing that forms a three-dimensional object by repeatedly hardening and laminating powder layers. The materials for forming three-dimensional objects can also be used as a model material and a support material for use in stereolithography (one specific example of additive manufacturing).

A three-dimensional object forming apparatuses for forming a three-dimensional object using the ink according to an embodiment of the present invention is not particularly limited and well-known apparatuses may be used, such as a container, a supplier, or a discharger of the ink and an active energy ray emitter.

Some embodiments of the present invention also provide a cured product of the ink and a processed product of a structural body in which the cured product formed on a substrate. The processed product may be produced by subjecting a sheet-like or film-like cured product or structural body to a molding processing such as heat stretching processing and punching processing. The processed product is preferably used for meters and operation panels of automobiles, office automation equipment, electric or electronic devices, and cameras, which typically need to be surface-decorated.

Image-Formed Matter

The image-formed matter according to an embodiment of the present invention comprises a recording medium and an image layer on the recording medium.

The image layer contains a cross-linking agent reactive with an acidic group, and a resin having the acidic group reactive with the cross-linking agent.

The recording medium has the acidic group reactive with the cross-linking agent on a surface thereof.

The image-formed matter can be formed by forming an image on a recording medium by the image forming apparatus or the image forming method.

Recording Apparatus and Recording Method

The ink according to an embodiment of the present invention can be suitably applied to various recording apparatuses employing an inkjet recording method, such as printers, facsimile machines, photocopiers, multifunction peripherals (having the functions of printer, facsimile machine, and photocopier), and three-dimensional objects forming apparatuses.

In the present disclosure, the recording apparatus and the recording method respectively refer to an apparatus capable of discharging inks or various treatment liquids to a recording medium and a method for recording an image on the recording medium using the apparatus. The recording medium refers to an article to which the inks or the various treatment liquids can be attached at least temporarily.

The recording apparatus may further optionally include, in addition to an ink discharge head, devices relating to feeding, conveying, and ejecting of the recording medium and other devices referred to as a pretreatment device or an aftertreatment device.

The recording apparatus may be further provided with an ultraviolet irradiator, as necessary, for irradiating the recording medium onto which the ink is has been discharged with ultraviolet rays.

The recording method may further optionally include a heating process and a drying process. The recording apparatus may further optionally include a heater for use in the heating process and a drying-curing device for use in the drying process.

In addition, the recording apparatus and the recording method are not limited to those producing merely meaningful visible images such as texts and figures with the ink. For example, the recording apparatus and the recording method can produce patterns like geometric design and three-dimensional images.

The recording apparatus includes both a serial-type device in which the discharge head is moved and a line-type device in which the discharge head is not moved, unless otherwise specified.

Furthermore, in addition to a desktop apparatus, the recording apparatus includes an apparatus capable of printing images on a wide recording medium with A0 size and a continuous printer capable of using continuous paper reeled up in a roll form as recording media.

Figure 2:
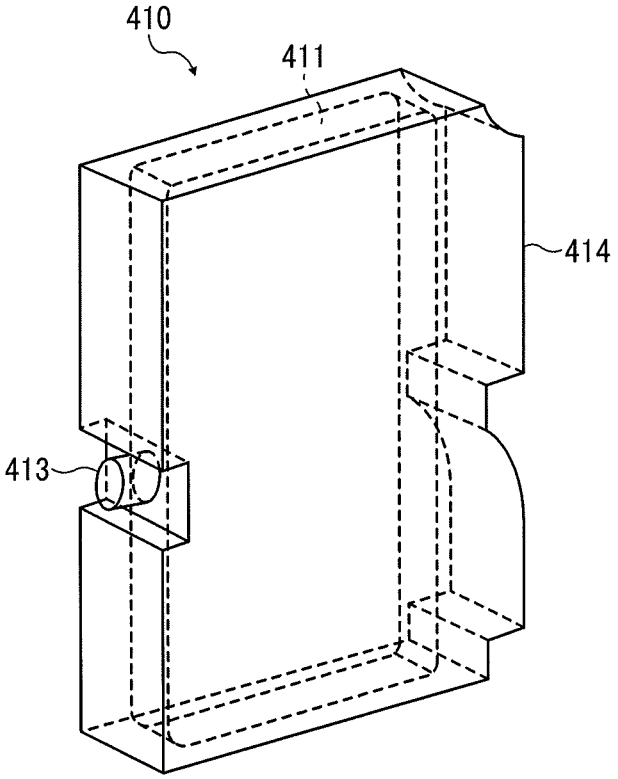
FIG. 2 is a perspective view of a main tank for use in the image forming apparatus illustrated in FIG. 1.

One example of the recording apparatus is described in detail below with reference to FIGS. 1 and 2. FIG. 1 is a perspective view of the recording apparatus. FIG. 2 is a perspective view of a main tank. An image forming apparatus 400, as one example of the recording apparatus, is a serial-type image forming apparatus. A mechanical unit 420 is disposed in a housing 401 of the image forming apparatus 400. Main tanks 410*k*, 410*c*, 410*m*, and 410*y* for respective colors of black (K), cyan (C), magenta (M), and yellow (Y) (hereinafter each referred to as "main tank 410") are each equipped with an ink container 411 made of a packaging material such as an aluminum laminate film. The ink container 411 is accommodated in a container casing 414 made of plastic. As a result, the main tank 410 is used as an ink cartridge of each color.

A cartridge holder 404 is disposed on the rear side of the opening when a cover 401*c* of the apparatus body is opened. The main tank 410 is detachably attachable to the cartridge holder 404. Thus, each ink discharging outlet 413 of the main tank 410 communicates with a discharge head 434 for each color via a supplying tube 436 for each color so that the ink can be discharged from the discharge head 434 to a recording medium.

Figure 3:
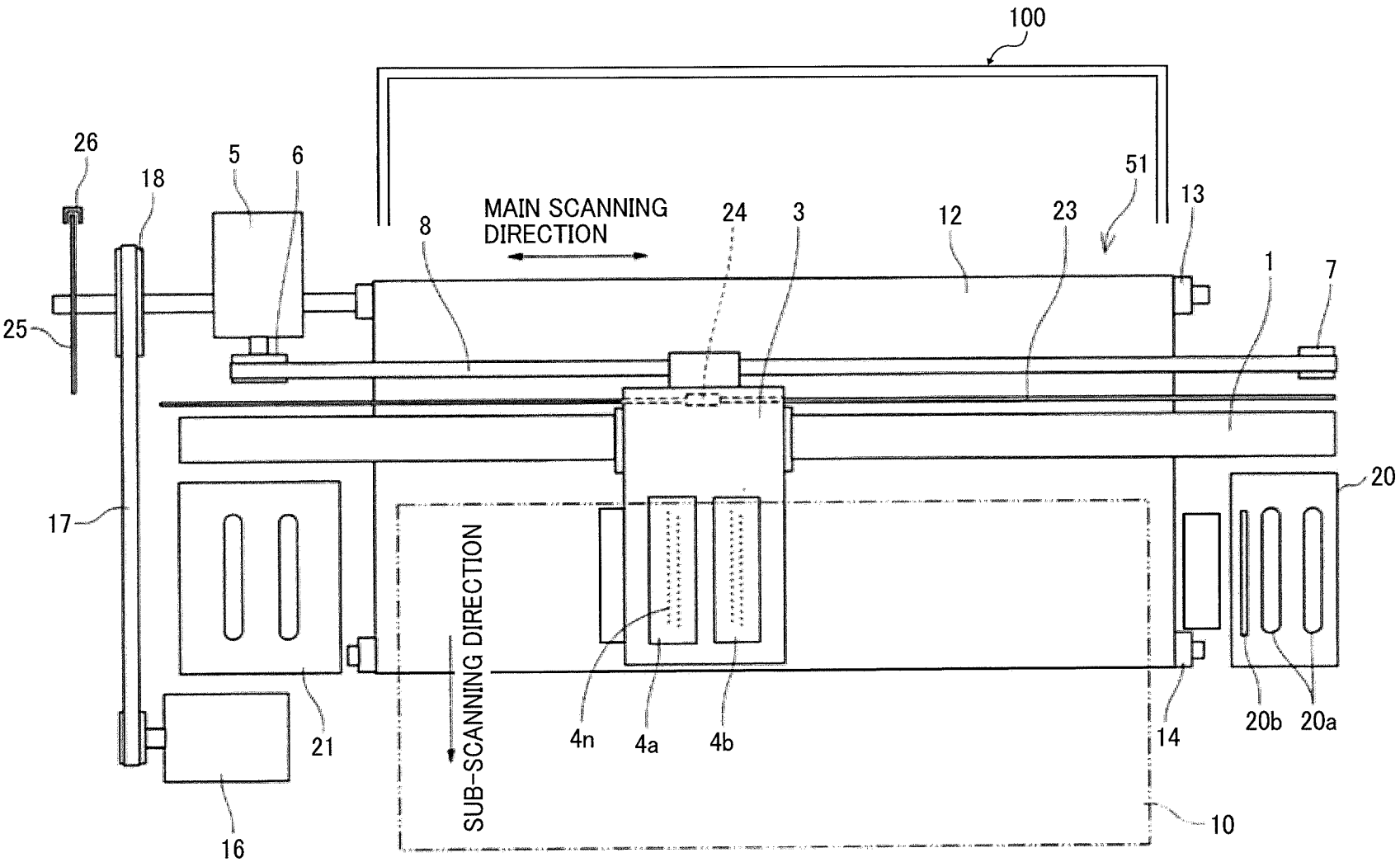
FIG. 3 is a schematic view of an image forming apparatus according to an embodiment of the present invention for conducting an image forming method according to an embodiment of the present invention.

Another image forming apparatus according to an embodiment of the present invention is described below with reference to FIG. 3. FIG. 3 is a plan view of the mechanical unit of the image forming apparatus according to an embodiment of the present invention.

This image forming apparatus is a serial-type inkjet recording apparatus. A carriage 3 is movably held by a main guide 1 laterally bridged between left and right side plates and a sub-guide. A main scanning motor 5 reciprocates the carriage 3 in the main scanning direction (carriage moving direction) via a timing belt 8 bridged between a drive pulley 6 and a driven pulley 7.

On the carriage 3, recording heads 4*a* and 4*b* (hereinafter each "recording head 4" when not distinguished) each comprising liquid discharge heads are mounted. The recording head 4 discharges ink droplets of, for example, yellow (Y), cyan (C), magenta (M), or black (K). The recording head 4 has nozzle arrays each comprising a plurality of nozzles, arranged in the sub-scanning direction that is orthogonal to the main scanning direction. The recording head 4 is mounted with its droplet discharging direction downward.

Figure 4:
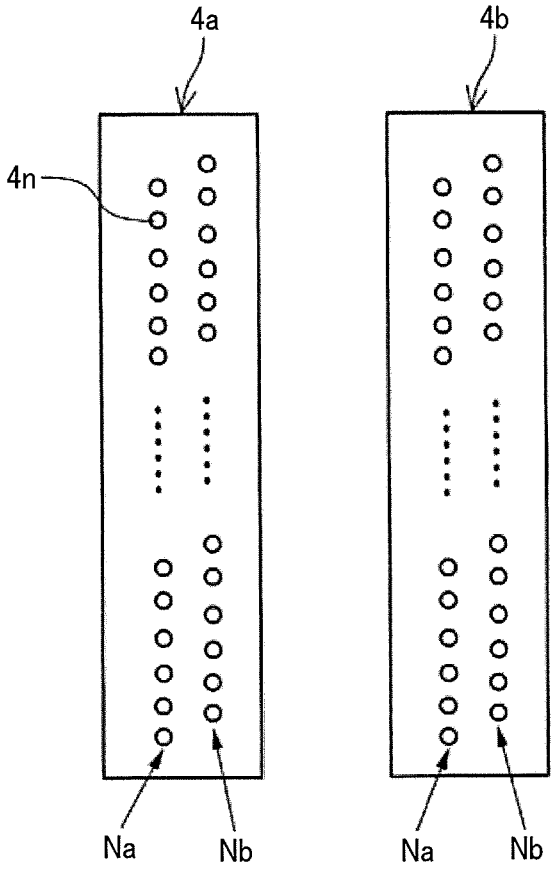
FIG. 4 is a plan view of a recording head in the image forming apparatus illustrated in FIG. 3.

As illustrated in FIG. 4, the recording head 4 may have two nozzle arrays Na and Nb in each of which a plurality of nozzles 4*n* are arranged. The nozzle array Na of the recording head 4*a* discharges droplets of black (K), and the other nozzle array Nb discharges droplets of cyan (C). The nozzle array Na of the recording head 4*b* discharges droplets of magenta (M), and the other nozzle array Nb discharges droplets of yellow (Y).

Examples of the liquid discharge head constituting the recording head 4 include, but are not limited to, a piezoelectric actuator such as a piezoelectric element, and a thermal actuator that utilizes phase change of a liquid caused by film boiling using an electrothermal conversion element such as a heat element.

On the other hand, a conveyance mechanism 51 for conveying a sheet 10 while facing the recording head 4 is equipped with a conveyance belt 12 as a conveyer. The conveyance belt 12 is an endless belt stretched between a conveyance roller 13 and a tension roller 14.

The conveyance belt 12 circumferentially moves in the sub-scanning direction as the conveyance roller 13 is rotationally driven by a sub-scanning motor 16 via a timing belt 17 and a timing pulley 18. The conveyance belt 12 is charged by a charging roller while circumferentially moving.

On one side of the carriage 3 in the main scanning direction, a maintenance mechanism 20 for maintaining the recording heads 4 is disposed lateral to the conveyance belt 12. On the other side, a dummy discharge receptacle 21 for receiving dummy discharge from the recording head 4 is disposed lateral to the conveyance belt 12.

The maintenance mechanism 20 includes caps 20*a* for capping the nozzle surface (surface on which the nozzles are formed) of the recording head 4, a wiper 20*b* for wiping the nozzle surface, and a dummy discharge receptacle to which liquid droplets not contributing to image formation are discharged.

An encoder scale 23 having a specific pattern thereon is disposed between both side plates along the main scanning direction of the carriage 3. The carriage 3 is provided with an encoder sensor 24 comprising a transmissive photosensor that reads the pattern on the encoder scale 23. The encoder scale 23 and the encoder sensor 24 configure a linear encoder (main scanning encoder) that detects movement of the carriage 3.

A code wheel 25 is mounted on the shaft of the conveyance roller 13, and an encoder sensor 26 comprising a transmissive photosensor that detects a pattern formed on the code wheel 25 is provided thereto. The code wheel 25 and the encoder sensor 26 configure a rotary encoder (sub-scanning encoder) that detects the amount of movement and the position of the conveyance belt 12.

In this image forming apparatus, the sheet 10 is fed from a sheet feeding tray 100, serving as a recording medium container, and adsorbed onto the charged conveyance belt 12. The sheet 10 is conveyed in the sub-scanning direction by circumferential movement of the conveyance belt 12.

By driving the ink recording heads 4 in response to an image signal while moving the carriage 3 in the main-scanning direction, ink droplets are discharged onto the sheet 10 not in motion, thus recording one line portion. The sheet 10 is thereafter conveyed for a specified distance and a next line portion is recorded thereon.

In response to a recording end signal or a signal indicating that the rear end of the sheet 10 has reached a recording area, the recording operation is ended and the sheet 10 is ejected onto an output tray.

In the present disclosure, "image forming", "recording", and "printing" are treated as synonymous terms.

In addition, "recording medium", "medium", and "print medium" are synonyms.

EXAMPLES

Further understanding can be obtained by reference to certain specific examples which are provided herein for the purpose of illustration only and are not intended to be limiting.

Preparation Example 1

Preparation of Cyan Pigment Dispersion Liquid

The below-listed materials were premixed. The resulting mixture was subject to a circulation dispersion treatment using a disk-type bead mill (KDL available from Shinmaru Enterprises Corporation, filled with zirconia ball media having a diameter of 0.3 mm) for 7 hours. Thus, a cyan pigment dispersion liquid was prepared.

Cyan pigment: 15 parts by mass

Anionic surfactant (PIONINE A-51-B available from Takemoto Oil & Fat Co., Ltd.): 2 parts by mass Ion-exchange water: 83 parts by mass Production Example 1

Preparation of Ink 1

The organic solvent, cross-linking agent, cyan pigment dispersion liquid, acrylic resin emulsion, surfactant, and ion-exchange water as described in Table 1 were mixed and stirred to prepare an ink solution.

The ink solution was filtered to remove coarse particles and foreign matter. Thus, an ink 1 was prepared.

Production Examples 2 to 17

Preparation of Inks 2 to 17

Inks 2 to 17 were each prepared in the same manner as in Production Example 1 except for changing the ink composition as described in Tables 1 to 4.

The compositions of the inks 1 to 17 are summarized in Tables 1 to 4.

TABLE 1

| Components | Production Example 1 Ink 1 | Production Example 2 Ink 2 | Production Example 3 Ink 3 | Production Example 4 Ink 4 | Production Example 5 Ink 5 |
|---|---|---|---|---|---|
| 1,2-Propanediol | 10.00 | 10.00 | 10.00 | 10.00 | 10.00 |
| 3-Methoxy-N,N-dimethylpropanamide | 5.00 | 5.00 | 5.00 | 5.00 | 5.00 |
| Carbodiimide (E-03A) | 10.00 | 5.00 | 2.00 | — | — |
| Oxazoline (K-2020E) | — | — | — | 10.00 | 5.00 |
| Photoacid Generator (WPAG-367) | — | — | — | — | — |
| Acrylic Resin Emulsion (MOVINYL 7470) | 11.36 | — | — | 11.36 | — |
| Acrylic-silicone Resin Emulsion (MOVINYL 7110) | — | 2.17 | — | — | 10.87 |
| Styrene-acrylic Resin Emulsion (MOVINYL 972) | — | — | 14.00 | — | — |
| Cyan Pigment Dispersion Liquid | 3.00 | 3.00 | 3.00 | 3.00 | 3.00 |
| Silicone-based Surfactant (BYK-348) | 0.80 | 0.80 | 0.80 | 0.80 | 0.80 |
| Ion-exchange Water | Remaining Amount | Remaining Amount | Remaining Amount | Remaining Amount | Remaining Amount |
| Total (% by mass) | 100.00 | 100.00 | 100.00 | 100.00 | 100.00 |

TABLE 2

| Components | Production Example 6 Ink 6 | Production Example 7 Ink 7 | Production Example 8 Ink 8 |
|---|---|---|---|
| 1,2-Propanediol | 10.00 | 10.00 | 10.00 |
| 3-Methoxy-N,N-dimethylpropanamide | 5.00 | 5.00 | 5.00 |
| Carbodiimide (E-03A) | — | 10.00 | — |
| Oxazoline (K-2020E) | 2.00 | — | 10.00 |
| Photoacid Generator (WPAG-367) | — | 10.00 | 1.00 |
| Acrylic Resin Emulsion (MOVINYL 7470) | — | 11.36 | 11.36 |
| Acrylic-silicone Resin Emulsion (MOVINYL 7110) | — | — | — |
| Styrene-acrylic Resin Emulsion (MOVINYL 972) | 10.00 | — | — |
| Cyan Pigment Dispersion Liquid | 3.00 | 3.00 | 3.00 |
| Silicone-based Surfactant (BYK-348) | 0.80 | 0.80 | 0.80 |
| Ion-exchange Water | Remaining Amount | Remaining Amount | Remaining Amount |
| Total (% by mass) | 100.00 | 100.00 | 100.00 |

TABLE 3

| Components | Production Example 9 Ink 9 | Production Example 10 Ink 10 | Production Example 11 Ink 11 | Production Example 12 Ink 12 | Production Example 13 Ink 13 |
|---|---|---|---|---|---|
| 1,2-Propanediol | 10.00 | 10.00 | 10.00 | 10.00 | 10.00 |
| 3-Methoxy-N,N-dimethylpropanamide | 5.00 | 5.00 | 5.00 | 5.00 | 5.00 |
| Carbodiimide (E-03A) | — | — | 10.00 | 5.00 | 5.00 |
| Oxazoline (K-2020E) | — | — | — | — | — |
| Photoacid Generator (WPAG-367) | — | — | — | 3.00 | 3.00 |
| Acrylic Resin Emulsion (MOVINYL 7470) | 11.36 | 22.73 | — | 11.36 | — |
| Acrylic-silicone Resin Emulsion (MOVINYL 7110) | — | — | 10.87 | — | — |
| Styrene-acrylic Resin Emulsion (MOVINYL 972) | — | — | — | — | 10.00 |
| Cyan Pigment Dispersion Liquid | 3.00 | 3.00 | 3.00 | 3.00 | 3.00 |
| Silicone-based Surfactant (BYK-348) | 0.80 | 0.80 | 0.80 | 0.80 | 0.80 |
| Ion-exchange Water | Remaining Amount | Remaining Amount | Remaining Amount | Remaining Amount | Remaining Amount |
| Total (% by mass) | 100.00 | 100.00 | 100.00 | 100.00 | 100.00 |

TABLE 4

| Components | Production Example 14 Ink 14 | Production Example 15 Ink 15 | Production Example 16 Ink 16 | Production Example 17 Ink 17 |
|---|---|---|---|---|
| 1,2-Propanediol | 10.00 | 10.00 | 10.00 | 10.00 |
| 3-Methoxy-N,N-dimethylpropanamide | 5.00 | 5.00 | 5.00 | 5.00 |
| Carbodiimide (E-03A) | 10.00 | — | 5.00 | 5.00 |
| Oxazoline (K-2020E) | — | — | — | — |
| Photoacid Generator (WPAG-367) | — | — | — | 2.00 |
| Acrylic Resin Emulsion (MOVINYL 7470) | — | — | 11.36 | 11.36 |
| Acrylic-silicone Resin Emulsion (MOVINYL 7110) | — | 10.87 | — | — |
| Styrene-acrylic Resin Emulsion (MOVINYL 972) | — | — | — | — |
| Cyan Pigment Dispersion Liquid | 3.00 | 3.00 | 3.00 | 3.00 |
| Silicone-based Surfactant (BYK-348) | 0.80 | 0.80 | 0.80 | 0.80 |
| Ion-exchange Water | Remaining Amount | Remaining Amount | Remaining Amount | Remaining Amount |
| Total (% by mass) | 100.00 | 100.00 | 100.00 | 100.00 |

Details of the ink components in the inks 1 to 17 shown in Tables 1 to 4 are as follows.

Resin Emulsions

Acrylic resin emulsion (MOVINYL 7470 available from The Nippon Synthetic Chemical Industry Co., Ltd., having a solid content concentration of 44% by mass, a resin having the acidic group)

Acrylic-silicone resin emulsion (MOVINYL 7110 available from The Nippon Synthetic Chemical Industry Co., Ltd., having a solid content concentration of 46% by mass, a resin having the acidic group)

Styrene-acrylic resin emulsion (MOVINYL 972 available from The Nippon Synthetic Chemical Industry Co., Ltd., having a solid content concentration of 50% by mass, a resin having the acidic group)

Surfactant

Silicone-based surfactant (BYK348 available from BYK Additives & Instruments)

Cross-Linking Agents

Carbodiimide (CARBODILITE E-03A available from Nisshinbo Chemical Inc.)

Oxazoline (EPOCROS K-2020E available from NIPPON SHOKUBAI CO., LTD.)

Photoacid Generator

WPAG-367 (available from FUJIFILM Wako Pure Chemical Corporation)

Examples 1 to 8 and Comparative Examples 1 to 9

Image Formation

An inkjet printer (modified machine of IPSiO GXe 5500 manufactured by Ricoh Co., Ltd.) was filled with each of the above-prepared cyan inks to print a solid image (1200 dpi×1200 dpi).

The IPSiO GXe 5500 had been modified so as to be able to reproduce a printing operation equivalent to an A4-size printing with a printing speed of 30 $m^2$/hr and a printing width of 150 cm and to change the drying temperature before, during, and after the recording. The drying temperature at the time of recording was set to 55 degrees C. to adjust the surface temperature of the recording medium to 50 degrees C. at the time of recording ("heating-drying treatment"). Thus, a solid image was formed on each of the recording media described in Tables 5 to 8.

In Examples 7 and 8 and Comparative Examples 4, 5, and 9, another modified machine of IPSiO GXe 5500 was used which had been modified to be able to perform ultraviolet irradiation during image formation.

Details of the recording media shown in Tables 5 to 8 are as follows.

Recording Media

Recording medium 1: polyvinyl alcohol (PVA) sheet, having the acidic group on a surface thereof Recording medium 2: polypropylene (PP) sheet Recording medium 3: cotton, having the acidic group on a surface thereof Recording medium 4: polyethylene (PE) fiber Adhesiveness Test Adhesiveness was evaluated based on the following criteria with specimens prepared according to JIS (Japanese Industrial Standards) K5600-5-6 (Testing methods for paints—Part 5: Mechanical property of film—Section 6: Adhesion test (Cross-cut test)). The results are shown in Tables 5 to 8.

Evaluation Criteria

Excellent: The edge of the cut is completely smooth and there is no peeling in any grid.

Good: Slight peeling of the coating film is observed at the intersection of the cuts.

Poor: The coating film is peeled off along the edge of the cut and/or at the intersections of the cuts.

Rub Resistance Test

Rub resistance was evaluated using an instrument AB-301 Color Fastness Rubbing Tester (available from TESTER SANGYO CO., LTD.) according to JIS K5701 (ISO 11628) that specifies testing methods for lithographic printing inks, vehicles, and printed matter.

Specifically, the surface of the coating film was rubbed with the canequim (No. 3) placed thereon with a load of 500 g back and forth for 20 times. The surface was visually observed after the rubbing to evaluate the degree of peeling and damage based on the following criteria. The results are shown in Tables 5 to 8.

Evaluation Criteria

Excellent: After the rubbing with the canequim, no film peeling was observed, or the substrate was not observed even when film peeling was observed.

Good: After the rubbing with the canequim, less than ¼ of the substrate was exposed by film peeling.

Poor: After the rubbing with the canequim, ¼ or more of the substrate was exposed by film peeling.

Discharge Stability

Each ink was discharged using the above-described inkjet printer. Specifically, each ink was continuously discharged for 48 hours onto a polyethylene terephthalate (PET) film as a recording medium. The occurrence of dot missing, bending of jetting, or ink scattering was visually observed during the discharging and evaluated based on the following criteria. The results are shown in Tables 5 to 8.

Evaluation Criteria

Good: The number of times of occurrence of dot missing, bending of jetting, or ink scattering was less than 50 times.

Poor: The number of times of occurrence of dot missing, bending of jetting, or ink scattering was 50 times or more.

Ethanol Resistance

A solid image was printed on each recording medium described in Tables 5 to 8 with each ink and dried at 80 degrees C. for 1 hour. The solid part of the image was rubbed 20 times with a cotton swab impregnated with a 50% by mass aqueous ethanol solution. Ethanol resistance was evaluated based on the degree of peeling of the coating film of the solid part of the image according to the following criteria. The results are shown in Tables 5 to 8.

Evaluation Criteria

Excellent: No peeling is observed in the coating film of the solid part of the image, and no stain is observed on the cotton swab.

Good: No peeling is observed in the coating film of the solid part of the image, but the cotton swab is slightly soiled.

Poor: Melting-out of the ink is observed in the coating film of the solid part of the image.

TABLE 5

| | Ink No. | Example 1 Ink 1 | Example 2 Ink 2 | Example 3 Ink 3 | Example 4 Ink 4 | Example 5 Ink 5 |
|---|---|---|---|---|---|---|
| Printing Conditions | Presence of Acidic Group on Recording Medium Surface | Yes | Yes | Yes | Yes | Yes |
| | Recording Medium Type | Recording Medium 1 (PVA) | Recording Medium 2 (PP) | Recording Medium 2 (PP) | Recording Medium 3 (Cotton) | Recording Medium 3 (Cotton) |
| | Surface Treatment of Recording Media | No | Corona | Plasma | No | No |
| | Heating-drying Treatment | Yes | Yes | Yes | Yes | Yes |
| | Ultraviolet Irradiation Treatment | No | No | No | No | No |
| Evaluation Results | Adhesiveness Test | Excellent | Good | Good | Excellent | Good |
| | Rub Resistance Test | Excellent | Good | Good | Good | Good |
| | Ethanol Resistance | Good | Good | Good | Good | Good |
| | Discharge Stability | Good | Good | Good | Good | Good |

TABLE 6

| | Ink No. | Example 6 Ink 6 | Example 7 Ink 7 | Example 8 Ink 8 |
|---|---|---|---|---|
| Printing Conditions | Presence of Acidic Group on Recording Medium Surface | Yes | Yes | Yes |
| | Recording Medium Type | Recording Medium 3 (Cotton) | Recording Medium 2 (PP) | Recording Medium 3 (Cotton) |
| | Surface Treatment of Recording Media | No | Corona | No |
| | Heating-drying Treatment | Yes | Yes | Yes |
| | Ultraviolet Irradiation Treatment | No | Yes | Yes |
| Evaluation Results | Adhesiveness Test | Good | Excellent | Excellent |
| | Rub Resistance Test | Good | Excellent | Excellent |

TABLE 6-continued

| Ink No. | Example 6 Ink 6 | Example 7 Ink 7 | Example 8 Ink 8 |
|---|---|---|---|
| Ethanol Resistance | Good | Excellent | Excellent |
| Discharge Stability | Good | Good | Good |

TABLE 7

| | Ink No. | Comp. Example 1 Ink 9 | Comp. Example 2 Ink 10 | Comp. Example 3 Ink 11 | Comp. Example 4 Ink 12 | Comp. Example 5 Ink 13 |
|---|---|---|---|---|---|---|
| Printing Conditions | Presence of Acidic Group on Recording Medium Surface | Yes | Yes | No | No | No |
| | Recording Medium Type | Recording Medium 2 (PP) | Recording Medium 2 (PP) | Recording Medium 2 (PP) | Recording Medium 2 (PP) | Recording Medium 2 (PP) |
| | Surface Treatment of Recording Media | Corona | Corona | No | No | No |
| | Heating-drying Treatment | Yes | Yes | Yes | Yes | Yes |
| | Ultraviolet Irradiation Treatment | No | No | No | Yes | Yes |
| Evaluation Results | Adhesiveness Test | Poor | Good | Poor | Poor | Poor |
| | Rub Resistance Test | Poor | Poor | Poor | Poor | Poor |
| | Ethanol Resistance | Poor | Poor | Poor | Poor | Poor |
| | Discharge Stability | Good | Poor | Good | Good | Good |

TABLE 8

| | Ink No. | Comp. Example 6 Ink 14 | Comp. Example 7 Ink 15 | Comp. Example 8 Ink 16 | Comp. Example 9 Ink 17 |
|---|---|---|---|---|---|
| Printing Con-ditions | Presence of Acidic Group on Recording Medium Surface | Yes | Yes | No | No |
| | Recording Medium Type | Recording Medium 3 (Cotton) | Recording Medium 3 (Cotton) | Recording medium 4 (PE fiber) | Recording medium 4 (PE fiber) |
| | Surface Treatment of Recording Media | No | No | No | No |
| | Heating-drying Treatment | Yes | Yes | Yes | Yes |
| | Ultraviolet Irradiation Treatment | No | No | No | Yes |
| Evalu-ation Results | Adhesiveness Test | Poor | Poor | Poor | Poor |
| | Rub Resistance Test | Poor | Poor | Poor | Poor |
| | Ethanol Resistance | Poor | Poor | Poor | Poor |
| | Discharge Stability | Good | Good | Good | Good |

It is clear from the results described in Tables 5 to 8, Examples 1 to 8 provide image-formed matter having excellent rub resistance, adhesiveness, and ethanol resistance and image forming methods having excellent discharge stability as compared to Comparative Examples 1 to 9.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming method comprising:

discharging an ink onto a recording medium, the ink comprising a cross-linking agent reactive with an acidic group and a resin having the acidic group reactive with the cross-linking agent, the recording medium having the acidic group reactive with the cross-linking agent on a surface thereof.

2. The image forming method according to claim 1, further comprising:

subjecting the recording medium to at least one of a corona discharge treatment and a plasma irradiation treatment before the ink lands on the recording medium.

3. The image forming method according to claim 1, wherein the cross-linking agent comprises at least one of a compound having oxazoline group and a compound having carbodiimide group.

4. The image forming method according to claim 1, wherein the ink further comprises a photoacid generator.

5. The image forming method according to claim 4, further comprising:

irradiating the recording medium onto which ink has been discharged with ultraviolet rays.

6. An image forming apparatus comprising:

a discharger containing an ink comprising a cross-linking agent reactive with an acidic group and a resin having the acidic group reactive with the cross-linking agent, the discharger configured to discharge the ink onto a recording medium having the acidic group reactive with the cross-linking agent on a surface thereof; and a recording medium container containing the recording medium.

7. The image forming apparatus according to claim 6 further comprising:

a surface treatment device configured to conduct at least one of a corona discharge treatment and a plasma irradiation treatment on the recording medium before the ink lands on the recording medium.

8. The image forming apparatus according to claim 6, wherein the cross-linking agent comprises at least one of a compound having oxazoline group and a compound having carbodiimide group.

9. The image forming apparatus according to claim 6, wherein the ink further comprises a photoacid generator.

10. The image forming apparatus according to claim 9, further comprising:

an ultraviolet irradiator configured to irradiate the recording medium onto which ink has been discharged with ultraviolet rays.

11. Image-formed matter comprising:

a recording medium; and an image layer on the recording medium, containing a cross-linking agent reactive with an acidic group and a resin having the acidic group reactive with the cross-linking agent, wherein the recording medium has the acidic group reactive with the cross-linking agent on a surface thereof.

* * * * *